US007514633B2

(12) United States Patent
Dell'Anna et al.

(10) Patent No.: US 7,514,633 B2
(45) Date of Patent: Apr. 7, 2009

(54) IMPACT RESISTANT CABLE

(75) Inventors: Gaia Dell'Anna, Milan (IT); Cristiana Scelza, Angellaro di Vallo della Lucania (IT); Sergio Belli, Leghorn (IT); Alberto Bareggi, Milan (IT)

(73) Assignee: Prysmian Cavi e Sistemi Energia S.R.L., Milan (IT)

( * ) Notice: Subject to any disclaimer, the term of this patent is extended or adjusted under 35 U.S.C. 154(b) by 0 days.

(21) Appl. No.: 10/581,186

(22) PCT Filed: Dec. 3, 2003

(86) PCT No.: PCT/EP03/13834

§ 371 (c)(1),
(2), (4) Date: May 2, 2007

(87) PCT Pub. No.: WO2005/055250

PCT Pub. Date: Jun. 16, 2005

(65) Prior Publication Data

US 2007/0272426 A1 Nov. 29, 2007

(51) Int. Cl.
*H01B 7/02* (2006.01)

(52) U.S. Cl. ..... 174/120 R

(58) Field of Classification Search ..... 174/105 R, 174/120 R, 120 SC

See application file for complete search history.

(56) References Cited

U.S. PATENT DOCUMENTS 4,104,210 A 8/1978 Coran et al.
4,322,260 A 3/1982 Conlon
5,153,381 A 10/1992 Ganatra et al.
5,231,249 A 7/1993 Kimura et al.
6,515,231 B1 2/2003 Strøbech et al.

(Continued)

FOREIGN PATENT DOCUMENTS

EP 0 324 430 B1 7/1989

(Continued)

OTHER PUBLICATIONS

Meurer et al., "Reduced Insulation Thickness for Extruded Medium-Voltage Power Cable Systems-Cables Performance and First Network Applications", IEEE, 2001, pp. 819-824.*

(Continued)

*Primary Examiner*—Chau N Nguyen
(74) *Attorney, Agent, or Firm*—Finnegan, Henderson, Farabow, Garrett & Dunner, L.L.P.

(57) ABSTRACT

A cable for use in a predetermined voltage class includes at least one conductor; at least one extruded insulating layer surrounding the conductor, the insulating layer being made from a non-crosslinked insulating material having at least one thermoplastic polymer and at least one dielectric liquid, the insulating layer having a thickness such as to provide a voltage gradient on the outer surface of the cable insulating layer not smaller than 1.0 kV/mm; and a protective element around the extruded insulating layer having a thickness and mechanical properties selected to provide a predetermined impact resistance capability, the protective element having at least one expanded polymeric layer, the thickness being sufficient to prevent detectable insulating layer damage upon impact of at least 25 J energy. The insulating layer thickness and the protective element thickness can be selected in combination to minimize the overall cable weight while preventing detectable insulating layer damage upon impact of at least 25 J energy.

41 Claims, 4 Drawing Sheets

U.S. PATENT DOCUMENTS

| | | | | |
|---|---|---|---|---|
| 7,196,270 | B2 * | 3/2007 | Perego et al. | 174/110 R |
| 2005/0046073 | A1 * | 3/2005 | Balconi et al. | 264/171.13 |

FOREIGN PATENT DOCUMENTS

| | | | |
|---|---|---|---|
| EP | 0 750 319 | B1 | 12/1996 |
| EP | 0 814 485 | B1 | 12/1997 |
| EP | 0 981 821 | B1 | 3/2000 |
| EP | 1 306 859 | A1 | 5/2003 |
| WO | WO 98/52197 | * | 11/1998 |
| WO | WO-99/33070 | | 7/1999 |
| WO | WO-00/41187 | | 7/2000 |
| WO | WO-01/37289 | A1 | 5/2001 |
| WO | WO-01/46965 | A1 | 6/2001 |
| WO | WO 02/03398 | * | 1/2002 |
| WO | WO-02/47092 | A1 | 6/2002 |
| WO | WO 2004/003940 | | 1/2004 |

OTHER PUBLICATIONS

Co-pending U.S. Appl. No. 10/518,468, filed Aug. 4, 2005.

International Search Report for PCT/EP03/05913 dated Sep. 19, 2003 (Demolder J.).

Office Action of Nov. 30, 2006, in co-pending U.S. Appl. No. 10/518,468.

Office Action of Jun. 6, 2007, in co-pending U.S. Appl. No. 10/518,468.

Office Action of Nov. 29, 2007, in co-pending U.S. Appl. No. 10/518,468.

Office Action of May 22, 2008, in co-pending U.S. Appl. No. 10/518,468.

* cited by examiner

IMPACT RESISTANT CABLE

CROSS REFERENCE TO RELATED APPLICATION

This application is a national phase application based on PCT/EP2003/013834, filed Dec. 3, 2003, the content of which is incorporated herein by reference.

BACKGROUND OF THE INVENTION

The present invention relates to a cable, in particular to an electrical cable for power transmission or distribution at medium or high voltage.

More in particular, the present invention relates to an electrical cable which combines high impact resistance and compactness of its design, wherein an extruded insulating layer made from a non-crosslinked insulating material comprising a thermoplastic polymer and a predetermined amount of a dielectric liquid is present.

In the present description, the term medium voltage is used to refer to a tension typically from about 10 kV to about 60 kV and the term high voltage refers to a tension above 60 kV (very high voltage is also sometimes used in the art to define voltages greater than about 150 kV or 220 kV, up to 500 kV or more); the term low voltage refers to a tension lower than 10 kV, typically greater than 100 V.

Furthermore, in the present description the term voltage class indicates a specific voltage value (e.g. 10 kV, 20 kV, 30 kV, etc.) included in a corresponding voltage range (e.g. low, medium or high voltage, or LV, MV, HV).

Said cable can be used for both direct current (DC) or alternating current (AC) transmission or distribution.

PRIOR ART

Cables for power transmission or distribution at medium or high voltage generally have a metal conductor which is surrounded, respectively, with a first inner semiconductive layer, an insulating layer and an outer semiconductive layer. In the following of the present description, said predetermined sequence of elements will be indicated with the term of "core".

In a position radially external to said core, the cable is provided with a metal shield (or screen), usually of aluminum, lead or copper, which is positioned radially external to said core, the metal shield generally consisting of a continuous tube or of a metallic tape shaped according to a tubular form and welded or sealed to ensure hermeticity. Said metal shield has two main functions: on the one hand it provides hermeticity against the exterior of the cable by interposing a barrier to water penetration in the radial direction, and on the other hand it performs an electrical function by creating, inside the cable, as a result of direct contact between the metal shield and the outer semiconductive layer of said core, a uniform electrical field of the radial type, at the same time cancelling the external electrical field of said cable. A further function is that of withstanding short-circuit currents.

In a configuration of the unipolar type, said cable has, finally, a polymeric oversheath in a position radially external to the metal shield mentioned above.

Moreover, cables for power transmission or distribution are generally provided with one or more layers for protecting said cables from accidental impacts which may occur on their external surface.

Accidental impacts on a cable may occur, for example, during transport thereof or during the laying step of the cable in a trench dug into the soil. Said accidental impacts may cause a series of structural damages to the cable, including deformation of the insulating layer and detachment of the insulating layer from the semiconductive layers, damages which may cause variations in the electrical voltage stress of the insulating layer with a consequent decrease in the insulating capacity of said layer.

In the cables which are currently available in the market, for example in those for low or medium voltage power transmission or distribution, metal armours capable of withstanding said impacts are usually provided in order to protect said cables from possible damages caused by accidental impacts. Generally, said armours are in the form of tapes or wires (preferably made of steel), or alternatively in the form of metal sheaths (preferably made of lead or aluminum). An example of such a cable structure is described in U.S. Pat. No. 5,153,381.

European Patent EP 981,821 discloses a cable which is provided with a layer of expanded polymeric material in order to confer to said cable a high resistance to accidental impacts, said layer of expanded polymeric material being preferably applied radially external to the cable core. Said proposed technical solution avoids the use of traditional metal armours, thereby reducing the cable weight as well as making the production process thereof easier.

European Patent EP 981,821 does not disclose a specific cable core design. In practice, the constitutive elements of the cable core are selected and dimensioned according to known Standards (e.g. to IEC Standard 60502-2 mentioned in the following of the present description).

Moreover, cables for power transmission or distribution are generally provided with one or more layers which ensure a barrier effect to block water penetration towards the interior (i.e. the core) of the cable.

Ingress of water to the interior of a cable is particularly undesirable since, in the absence of suitable solutions designed to plug the water, once the latter has penetrated it is able to flow freely inside the cable. This is particularly harmful in terms of the integrity of the cable as problems of corrosion may develop within it as well as problems of accelerated aging with deterioration of the electric features of the insulating layer.

For example, the phenomenon of "water treeing" is known which mainly consists in the formation of microscopic channels in a branch structure ("trees") due to the combined action of the electrical field generated by the applied voltage, and of moisture that has penetrated inside said insulating layer. For example, the phenomenon of "water treeing" is described in European Patents EP 750,319 and EP 814,485.

This means, therefore, that in case of water penetration to the interior of a cable, the latter will have to be replaced. Moreover, once water has reached joints, terminals or any other equipment electrically connected to one end of the cable, the water not only stops the latter from performing its function, but also damages said equipment, in most cases causing a damage that is irreversible and significant in economic terms.

Water penetration to the interior of a cable may occur through multiple causes, especially when said cable forms part of an underground installation. Such penetration may occur, for example, by simple diffusion of water through the polymeric oversheath of the cable or as a result of abrasion, accidental impact or the action of rodents, factors that may lead to an incision or even to rupture of the oversheath of the cable and, therefore, to the creation of a preferred route for ingress of water to the interior of the cable.

Numerous solutions are known for tackling said problems. For example, International Patent Application WO 99/33070 describes the use of a layer of expanded polymeric material arranged in direct contact with the core of a cable, in a position directly beneath the metallic screen of the cable, and possessing predefined semiconducting properties with the aim of guaranteeing the necessary electrical continuity between the conducting element and the metallic screen.

The technical problem faced in WO 99/33070 was that the covering layers of a cable are continuously subjected to mechanical expansions and contractions due to the numerous thermal cycles that the cable undergoes during its normal use. Said thermal cycles, caused by the daily variations in strength of the electric current being carried, which are associated with corresponding temperature variations inside the cable itself, lead to the development of radial stresses inside the cable which affect each of said layers and, therefore, also its metallic screen. This means, therefore, that the latter may undergo relevant mechanical deformations, with formation of empty spaces between the screen and the outer semiconducting layer and possible generation of non-uniformity in the electric field, or even resulting, with passage of time, in rupture of the screen itself. This problem was solved by inserting, under the metallic screen, a layer of expanded polymeric material capable of absorbing, elastically and uniformly along the cable, the aforementioned radial forces of expansion/contraction so as to prevent possible damage to the metallic screen. Furthermore, WO 99/33070 discloses that, inside said expanded polymeric material, positioned beneath the metallic screen, a water swellable powder material is embedded, which is able to block moisture and/or small amounts of water that might penetrate to the interior of the cable even under said metallic screen.

As it will be recalled in more details in the following of the present description, in the same conditions of electrical voltage applied to a cable, cross-section thereof and insulating material of said cable insulating layer, a decrease of the cable insulating layer thickness causes the electrical voltage stress (electrical gradient) across said insulating layer to increase.

Therefore, generally the insulating layer of a given cable is designed, i.e. is dimensioned, so as to withstand the electrical stress conditions prescribed for the category of use of said given cable.

Generally, even though a cable is designed to provide for a thickness of the insulating layer which is larger than needed so that a suitable safety factor is included, an accidental impact occurring on the external surface of the cable can cause a permanent deformation of the insulating layer and reduce, even remarkably, the thickness thereof in correspondence of the impact area, thereby possibly causing an electrical breakdown therein when the cable is energized.

In fact, generally the materials which are typically used for the cable insulating layer and oversheath elastically recover only part of their original size and shape after the impact. Therefore, after the impact, even if the latter has taken place before the cable is energized, the insulating layer thickness withstanding the electric stress is inevitably reduced.

Furthermore, when a metal shield is present in a position radially external to the cable insulating layer, the material of said shield is permanently deformed by the impact, fact which further limits the elastic recover of the deformation so that the insulating layer is restrained from elastically recovering its original shape and size.

Consequently, the deformation, or at least a significant part thereof, caused by an accidental impact is maintained after the impact, even if the cause of the impact itself has been removed, said deformation resulting in the decrease of the insulating layer thickness which changes from its original value to a reduced one. Therefore, when the cable is energized, the real insulating layer thickness which bears the electrical voltage stress (Γ) in the impact area is said reduced value and not the starting one.

SUMMARY OF THE INVENTION

According to the present invention, the Applicant observed that the use of an expanded protection of specific design may not only replace other types of protections, but also enable to use a smaller insulating layer size, thereby obtaining a more compact cable without reducing its reliability.

The Applicant has perceived that by providing a cable with a protective element comprising an expanded polymeric layer suitable for conferring to the cable a predetermined resistance to accidental impacts it is possible to make the cable design more compact than that of a conventional cable.

The Applicant has observed that the expanded polymeric layer of said protective element better absorbs the accidental impacts which may occur on the cable external surface with respect to any traditional protective element, e.g. the above mentioned metallic armours, and thus the deformation occurring on the cable insulating-layer due to an accidental impact can be advantageously decreased.

The Applicant has perceived that by providing a cable with a protective element comprising an expanded polymeric layer it is possible to advantageously reduce the cable insulating layer thickness up to the electrical stress compatible with the electrical rigidity of the insulating material. Therefore, according to the present invention it is possible to make the cable construction more compact without decreasing its electrical and mechanical resistance properties.

The Applicant has found that, by providing a cable with a protective element comprising an expanded polymeric layer, the thickness of the latter can be advantageously correlated with the thickness of the insulating layer in order to minimize the overall cable weight while ensuring a safe functioning of the insulating layer from an electrical point of view as well as providing the cable with a suitable mechanical protection against any accidental impact which may occur. In particular, the thickness of said expanded polymeric layer can be selected in order to minimize the deformation of the cable insulating layer upon impact so that a reduced insulating layer thickness can be provided to said cable.

Moreover, the Applicant has perceived the problem of producing a cable which not only is more compact, but which is also particularly economic, without impairing its ability to withstand the stresses, both of mechanical and electrical type, associated with its intended use.

In view of that, the Applicant has found that by combining an insulating layer made from a non-crosslinked insulating material, in particular, from a non-crosslinked insulating material comprising a thermoplastic polymer and a predetermined amount of a dielectric liquid, a reduced insulating layer thickness and an extruded protective element comprising at least one expanded polymeric layer, the cable can be produced by means of a continuous process, without any intermediate phase or rest off-line, while maintaining or increasing its ability to resist to impacts and mechanical stresses, and without damaging the ability of said insulating layer to operate at the intended operating conditions. As a matter of fact, the obtained cable is able to operate at high temperatures, of at least 90° C. and beyond, in particular up to 110° C. for continuous use and up to 140° C. in the case of current overload.

The possibility of using a continuous process allows to produce a cable in a faster way with respect to the discontinuous process as required by a cable with a crosslinked insulating material. For example, by means of a continuous process, a cable with a non-crosslinked insulating material can be produced at a line speed of about 60 m/min as; by comparison, a cable of a similar size with a crosslinked insulating material, can be produced by means of a discontinuous process at a line speed of about 10 m/min –15 m/min.

Moreover, the reduced insulating layer thickness allows to obtain a more compact cable: for example, a 20 kV class voltage cable having a conductor cross-section of 50 $mm^2$ generally have an overall diameter of about 34 mm as, in the case of the cable of the present invention, the same type of cable, will have an overall diameter of from about 25 mm to about 31 mm.

Consequently, the combination of a continuous process, with a reduced insulating layer thickness and with an extruded protecting element, can provide a significant reduction in the manufacturing costs.

Moreover, as the insulating material is non-crosslinked, it can be recycled at the end of its life.

In a first aspect the present invention relates to a cable for use in a predetermined voltage class, said cable comprising:

at least one conductor;

at least one extruded insulating layer surrounding said conductor, said insulating layer being made from a non-crosslinked insulating material comprising at least one thermoplastic polymer and at least one dielectric liquid, said insulating layer having a thickness such as to provide a voltage gradient on the outer surface of the cable insulating layer not smaller than 1.0 kV/mm; and a protective element around said extruded insulating layer having a thickness and mechanical properties selected to provide a predetermined impact resistance capability, said protective element comprising at least one expanded polymeric layer, said thickness being sufficient to prevent a detectable insulating layer damage upon impact of at least 25 J energy.

The Applicant has found that the insulating layer thickness can be determined by selecting the most restrictive electric limitation to be considered for its intended use, without the need of adding extra thickness to take into account insulating layer deformations due to impacts.

For example, it is typical to consider in a cable design as significant electric limitations the maximum voltage gradient on the conductor surface (or on the outer surface of the inner semiconductive layer extruded thereon), and the gradient at the joints, i.e. the gradient on the outer surface of the cable insulating layer.

Preferably, the insulating layer thickness is at least 20% smaller than the corresponding insulating layer thickness provided for in IEC Standard 60502-2. More preferably, the reduction of the insulating layer thickness is comprised in the range from 20% to 40%. Even more preferably, the insulating layer thickness is about 60% smaller than the corresponding insulating layer thickness provided for in said IEC Standard.

Preferably, the thickness of said insulating layer is selected so that the electrical voltage stress within the insulating layer when the cable is operated at a nominal voltage comprised in said predetermined voltage class ranges among values comprised between 2.5 kV/mm and 18 kV/mm.

Preferably, when said predetermined voltage class is 10 kV, said insulating layer thickness is not higher than 2.5 mm; when said predetermined voltage class is 20 kV said insulating layer thickness is not higher than 4 mm; when said predetermined voltage class is 30 kV said insulating layer thickness is not higher than 5.5 mm.

According to one preferred embodiment, the thermoplastic polymer of the insulating material can be selected from: polyolefins, copolymers of different olefins, copolymers of an olefin with an ethylenically unsaturated ester, polyesters, polyacetates, cellulose polymers, polycarbonates, polysulphones, phenol resins, urea resins, polyketones, polyacrylates, polyamides, polyamines, or mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylenelbutyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); or copolymers thereof or mixtures thereof.

In order to obtain suitable electric properties, in particular in the medium and high voltage field, said thermoplastic polymer can be selected from polyolefin compounds.

Preferably, said thermoplastic polymer may be selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of from 20 J/g to 100 J/g;

(b) a mechanical mixture comprising at least one propylene homopolymer or copolymer (a) and (c) at least one elastomeric copolymer of ethylene with at least one aliphatic α-olefin, and optionally a polyene.

According to one preferred embodiment, the propylene homopolymer or copolymer (a) which can be used in the present invention has a melting point of from 140° C. to 170° C.

Preferably, the propylene homopolymer or copolymer (a) has a melting enthalpy of from 30 J/g to 85 J/g.

Said melting enthalpy ($\Delta H_m$) can be determined by Differential Scanning Calorimetry (DSC) analysis.

Preferably, the propylene homopolymer or copolymer (a) has a flexural modulus, measured according to ASTM standard D790, at room temperature, of from 30 MPa to 1400 MPa, and more preferably from 60 MPa to 1000 MPa.

Preferably, the propylene homopolymer or copolymer (a) has a melt flow index (MFI), measured at 230° C. with a load of 21.6 N according to ASTM standard D1238/L, of from 0.05 dg/min to 10.0 dg/min, more preferably from 0.4 dg/min to 5.0 dg/min.

If a copolymer of propylene with at least one olefin comonomer (a) is used, this latter is preferably present in a quantity of less than or equal to 15 mol %, and more preferably of less than or equal to 10 mol %. The olefin comonomer is, in particular, ethylene or an α-olefin of formula $CH_2{=}CH{-}R$, where R is a linear or branched $C_2$-$C_{10}$ alkyl, selected, for example, from: 1-butene, 1-pentene, 4-methyl-1-pentene, 1-hexene, 1-octene, 1-decene, 1-dodecene, or mixtures thereof Propylene/ethylene copolymers are particularly preferred.

Preferably, said propylene homopolymer or copolymer (a) is selected from:

($a_1$) propylene homopolymers or copolymers of propylene with at least one olefin comonomer selected from ethylene and an α-olefin other than propylene, having a flexural modulus generally of from 30 MPa to 900 MPa, and preferably of from 50 MPa to 400 MPa;

($a_2$) heterophase copolymers comprising a thermoplastic phase based on propylene and an elastomeric phase based on ethylene copolymerized with an α-olefin, preferably with propylene, wherein the elastomeric phase is preferably present in a quantity of at least 45 wt % with respect to the total weight of the heterophase copolymer.

Particularly preferred of said class ($a_1$) are propylene homopolymers or copolymers of propylene with at least one olefin comonomer selected from ethylene and an α-olefin other than propylene, said homopolymers or copolymers having:

a melting point of from 140° C. to 170° C.;

a melting enthalpy of from 30 J/g to 80 J/g;

a fraction soluble in boiling diethyl ether in an amount of less than or equal to 12 wt %, preferably from 1 wt % to 10 wt %, having a melting enthalpy of less than or equal to 4 J/g, preferably less than or equal to 2 J/g;

a fraction soluble in boiling n-heptane in an amount of from 15 wt % to 60 wt %, preferably from 20 wt % to 50 wt %, having a melting enthalpy of from 10 J/g to 40 J/g, preferably from 15 J/g to 30 J/g; and a fraction insoluble in boiling n-heptane in an amount of from 40 wt % to 85 wt %, preferably from 50 wt % to 80 wt %, having a melting enthalpy of greater than or equal to 45 J/g, preferably from 50 J/g to 95 J/g.

Further details concerning these materials and their use in cables covering layers are given in Intenational Patent Application WO 01/37289.

The heterophase copolymers of class ($a_2$) are obtained by sequential copolymerization of: i) propylene, possibly containing minor quantities of at least one olefin comonomer selected from ethylene and an α-olefin other than propylene; and then of: ii) a mixture of ethylene with an α-olefin, in particular propylene, and possibly with minor portions of a diene.

Particularly preferred of said class ($a_2$) are heterophase copolymers wherein the elastomeric phase consists of an elastomeric copolymer of ethylene and propylene comprising from 15 wt % to 50 wt % of ethylene and from 50 wt % to 85 wt % of propylene with respect to the weight of the elastomeric phase. Further details concerning these materials and their use in cables covering layers are given in International Patent Application WO 00/41187 in the name of the Applicant.

Products of class ($a_1$) are available commercially for example under the trademark Moplene® RP 210 G of Basell or Borsoft® SA 233 CF of Borealis.

Products of class ($a_2$) are available commercially for example under the trademark Hifax® CA 10 A, Moplen® EP 310 G, or Adflex® Q 200 F of Basell.

According to one preferred embodiment, the elastomeric copolymer of ethylene (c) has a melting enthalpy of less than 30 J/g. The quantity of said elastomeric copolymer (c) is generally less than 70% by weight, preferably of from 20% by weight to 60% by weight, with respect to the total weight of the thermoplastic base material.

With reference to the elastomeric copolymer of ethylene (c), the term "aliphatic α-olefin" generally means an olefin of formula $CH_2{=}CH{-}R$, wherein R represents a linear or branched alkyl group containing from 1 to 12 carbon atoms. Preferably, the aliphatic α-olefin is selected from propylene, 1-butene, isobutylene, 1-pentene, 4-methyl-1-pentene, 1-hexene, 1-octene, 1-dodecene, or mixtures thereof. Propylene, 1-butene, 1-hexene and 1-octene are particularly preferred.

With reference to the elastomeric copolymer of ethylene (c), the term "polyene" generally means a conjugated or non-conjugated diene, triene or tetraene. When a diene comonomer is present, this comonomer generally contains from 4 to 20 carbon atoms and is preferably selected from: linear conjugated or non-conjugated diolefins such as, for example, 1,3-butadiene, 1,4-hexadiene, 1,6-octadiene, and the like; monocyclic or polycyclic dienes such as, for example, 1,4-cyclohexadiene, 5-ethylidene-2-norbornene, 5-methylene-2-norbornene, vinylnorbornene, or mixtures thereof. When a triene or tetraene comonomer is present, this comonomer generally contains from 9 to 30 carbon atoms and is preferably selected from trienes or tetraenes containing a vinyl group in the molecule or a 5-norbornen-2-yl group in the molecule. Specific examples of triene or tetraene comonomers which can be used in the present invention are: 6,10-dimethyl-1,5,9-undecatriene, 5,9-dimethyl- 1,4,8-decatriene, 6,9-dimethyl-1,5,8-decatriene, 6,8,9-trimethyl-1,6,8-decatriene, 6,10,14-trimethyl-1,5,9,13-pentadecatetraene, or mixtures thereof. Preferably, the polyene is a diene.

Particularly preferred elastomeric copolymers of ethylene (c) are:

($c_1$) copolymers having the following monomer composition: 35 mol %-90 mol % of ethylene; 10 mol %-65 mol % of an aliphatic α-olefin, preferably propylene; 0 mol %-10 mol % of a polyene, preferably a diene, more preferably, 1,4-hexadiene or 5-ethylene-2-norbornene (for example, EPR and EPDM rubbers, such as the products Dutral® (Enichem) or Nordele® (Dow-DuPont);

($c_2$) copolymers having the following monomer composition: 75 mol %-97 mol %, preferably 90 mol %-95 mol %, of ethylene; 3 mol %-25 mol %, preferably 5 mol %-10 mol %, of an aliphatic α-olefin; 0 mol %-5 mol %, preferably 0 mol %-2 mol %, of a polyene, preferably a diene (for example ethylene/1-octene copolymers, such as the products Engage® of DuPont-Dow Elastomers).

According to one preferred embodiment, the dielectric liquid of the insulating material can be selected from: mineral oils such as, for example, naphthenic oils, aromatic oils such as alkyl benzenes (for example, dibenzyltoluene, dodecylbenzene, di(octylbenzyl)toluene), paraffinic oils, polyaromatic oils, said mineral oils optionally containing at least one heteroatom selected from oxygen, nitrogen or sulphur; liquid paraffins; vegetable oils such as, for example, soybean oil, linseed oil, castor oil; oligomeric aromatic polyolefins; paraffinic waxes such as, for example, polyethylene waxes, polypropylene waxes; synthetic oils such as, for example, silicone oils, aliphatic esters (such as, for example, tetraesters of pentaerythritol, esters of sebacic acid, phthalic esters), olefin oligomers (such as, for example, optionally hydrogenated polybutenes or polyisobutenes); or mixtures thereof. Aromatic oils (in particular, alkyl benzenes), paraffinic oils, naphthenic oils, are particularly preferred.

The dielectric liquid suitable for implementing the present invention has good heat resistance, considerable gas absorption capacity, in particular hydrogen absorption, and high resistance to partial discharges, so that the dielectric strength of the insulating material is improved. Moreover, said dielectric liquid does not negatively affect the dielectric losses of the insulating material even at high temperatures and high electrical gradients.

Preferably, the weight ratio of dielectric liquid to thermoplastic polymer of the present invention is generally between 1:99 and 25:75, more preferably between 2:98 and 20:80, and even more preferably between 3:97 and 10:90.

Examples of said dielectric liquid which can be used according to the present invention and which are currently commercially available are the products Jarylec® Exp3 of Elf Atochem or Sunpar® 2280 of Sunoco.

In making the insulating layer for the cable according to the present invention, other conventional components can be added to the above disclosed insulating material, such as antioxidants, processing aids, water tree retardants, or mixtures thereof.

Conventional antioxidants suitable for the purpose are for example distearyl- or dilauryl-thiopropionate and pentaerythrityl-tetrakis[3-(3,5-di-t-butyl4-hydroxyphenyl)propionate], or mixtures thereof.

Processing aids which can be added to the insulating material include, for example, calcium stearate, zinc stearate, stearic acid, or mixtures thereof.

As stated above, said insulating material shows indeed good mechanical characteristics both at ambient temperature and under hot conditions, and also shows improved electrical properties. In particular, said insulating material enables high operating temperature to be reached, comparable with or even exceeding that of cables with insulating layers consisting of crosslinked insulating materials.

The insulating material according to the present invention can be prepared by mixing together the thermoplastic polymer, the dielectric liquid and any other additives possibly present by using methods known in the art. Mixing can be carried out for example by an internal mixer of the type with tangential rotors (Banbury) or with interpenetrating rotors, or, preferably, in a continuous mixer of Ko-Kneader (Buss) type, or of co- or counter-rotating double-screw type.

Alternatively, the dielectric liquid of the present invention can be added to the thermoplastic polymer during the extrusion step by direct injection into the extruder cylinder as disclosed, for example, in International Patent Application WO 02/47092.

Due to their high operating temperature and their low dielectric losses, the cables of the invention may carry, for the same voltage, a power at least equal to or even greater than that trasportable by a traditional cable with XLPE covering.

Preferably, said conductor is a solid rod.

Preferably, the cable further includes an electric shield surrounding said insulating layer, said electric shield comprising a metal sheet shaped in tubular form.

According to one preferred embodiment of the present invention, said protective element is placed in a position radially external to said insulating layer.

Preferably, the degree of expansion of the expanded polymeric layer of said protective element is comprised between 20% and 200%, more preferably between 25% and 130%.

Preferably, the thickness of the expanded polymeric layer of said protective element is comprised between 1 mm and 5 mm.

In a further aspect of the present invention, the abovementioned protective element further includes at least one non-expanded polymeric layer coupled with said expanded polymeric layer.

In the case an impact on the cable occurs, the Applicant has found that the absorbing (i.e. dumping) function of the expanded polymeric layer is advantageously incremented by associating the latter with at least one non-expanded polymeric layer.

Therefore, according to one preferred embodiment of the present invention, said protective element further comprises a first non-expanded polymeric layer in a position radially external to said expanded polymeric layer.

According to a further embodiment, the protective element of the present invention further comprises a second non-expanded polymeric layer in a position radially internal to said expanded polymeric layer.

Preferably, said at least one non-expanded polymeric layer is made of a thermoplastic material.

More preferably, said at least one non-expanded polymeric layer is made of a polyolefin polymer.

Preferably, said at least one non-expanded polymeric layer has a thickness in the range of from 0.2 mm to 1 mm.

In a further aspect, the Applicant has found that, due to an impact occurred on the cable, the deformation of the cable insulating layer is advantageously reduced if the protective element of the present invention is combined with a further expanded polymeric layer provided to the cable in a position radially internal to the protective element.

Furthermore, the Applicant has found that by providing a further expanded polymeric layer in combination with said protective element allows to increase the absorbing (dumping) property of said protective element.

As mentioned above, once an insulating layer thickness has been selected, the combined presence of said expanded polymeric layer of the protective element and of said further expanded polymeric layer enables to obtain substantially the same impact protection with a reduced overall dimension of the cable.

According to one preferred embodiment of the invention, said further expanded polymeric layer is in a position radially internal to said protective element.

Preferably, said further expanded polymeric layer is in a position radially external to said insulating layer.

Preferably, said further expanded polymeric layer is a water-blocking layer and includes a water swellable material.

Preferably, said further expanded polymeric layer is semiconductive.

Preferably, the cable according to the present invention is used for voltage classes of medium or high voltage ranges.

In a further aspect of the present invention, the Applicant has found that, by providing the cable with a protective element comprising at least one expanded polymeric layer, the thickness of said protective element decreases in correspondence with the increase of the conductor cross-sectional area.

Therefore, the present invention further relates to a cable for use in a predetermined voltage class, said cable comprising:

at least one conductor;

at least one extruded insulating layer surrounding said conductor, said insulating layer being made from a non-crosslinked insulating material comprising at least one thermoplastic polymer and at least one dielectric liquid; and a protective element around said insulating layer comprising at least one expanded polymeric layer;

characterized in that the protective element thickness has a value smaller than 7.5 mm for a conductor cross-sectional area greater than or equal to 50 $mm^2$ and a value greater than 8.5 mm for a conductor cross-sectional area smaller than 50 $mm^2$.

Preferably, in the case said predetermined voltage class is higher than 60 kV, said insulating layer is not detectably damaged upon impact of an energy of at least 70 J.

Preferably, in the case said predetermined voltage class is not higher than 60 kV, said insulating layer is not detectably damaged upon impact of an energy of at least 50 J.

Preferably, in the case said predetermined voltage class is lower than 10 kV, said insulating layer is not detectably damaged upon impact of an energy of at least 25 J.

If a family (group) of cables suitable for the same voltage class (e.g. 10 kV, 20 kV, 30 kV, etc.) is considered, the Applicant has found that when the cable conductor cross-sectional area increases, the thickness of the cable protective element may advantageously decrease while maintaining substantially the same impact protection. This means that a cable of small conductor cross-sectional area can be provided with a protective element which is thicker than that of a cable having a large conductor cross-sectional area.

Therefore, the present invention further concerns a group of cables selected for a predetermined voltage class and having different conductor cross-sectional areas, each cable comprising:

at least one conductor;

at least one extruded insulating layer surrounding said conductor, said insulating layer being made from a non-crosslinked insulating material comprising at least one thermoplastic polymer and at least one dielectric liquid; and a protective element around said insulating layer comprising at least one expanded polymeric layer;

wherein the thickness of said protective element is selected in inverse relationship with the conductor cross-sectional area.

Preferably, said protective element further includes at least one non-expanded polymeric layer coupled with said expanded polymeric layer.

Preferably, each cable comprises a further expanded polymeric layer in a position radially internal to said protective element.

According to a further aspect, the present invention further relates to a method for designing a cable comprising at least one conductor, at least one extruded insulating layer surrounding said conductor, said insulating layer being made from a non-crosslinked insulating material comprising at least one thermoplastic polymer and at least one dielectric liquid, and a protective element surrounding said insulating layer, said protective element including at least one polymeric expanded layer, said method comprising the steps of:

selecting a conductor cross-sectional area;

determining the thickness for said insulating layer compatible with safe operation in a predetermined voltage class on said selected conductor cross-sectional area in correspondence of one of a number of predetermined electrical limit conditions;

selecting the maximum insulating layer thickness among those determined in said number of predetermined electrical limit conditions;

determining the thickness of said protective element so that said insulating layer is not detectably damaged upon an impact is caused on the cable of an energy of at least 50 J; and using said selected insulating layer and said determined protective element thickness in the design of a cable for said predetermined voltage class and selected conductor cross-sectional area.

According to the present invention, a deformation (i.e. a damage) of the cable insulating layer lower or equal to 0.1 mm is considered to be undetectable. Therefore, it is assumed that the cable insulating layer is undamaged in the case a deformation lower than 0.1 mm occurs.

In the case the cable protective element consists of said expanded polymeric layer, the step of determining the thickness of said protective element consists in determining the thickness of said expanded polymeric layer.

In the case the cable protective element further comprises a non-expanded polymeric layer associated with said expanded polymeric layer, the step of determining the thickness of said protective element comprises the step of determining the thickness of said non-expanded polymeric layer.

Preferably, the step of determining the thickness of said non-expanded polymeric layer comprises the step of correlating in inverse relationship the thickness of said non-expanded polymeric layer with the conductor cross-sectional area.

The present invention is advantageously applicable not only to electrical cables for the transport or distribution of power, but also to cables of the mixed power/telecommunications type which include an optical fiber core. In this sense, therefore, in the rest of the present description and in the claims which follow the term "conductive element" means a conductor of the metal type or of the mixed electrical/optical type.

BRIEF DESCRIPTION OF THE DRAWINGS

Further details will be illustrated in the detailed description which follows, with reference to the appended drawings, in which.

DETAILED DESCRIPTION OF THE PREFERRED EMBODIMENTS

Figure 1:
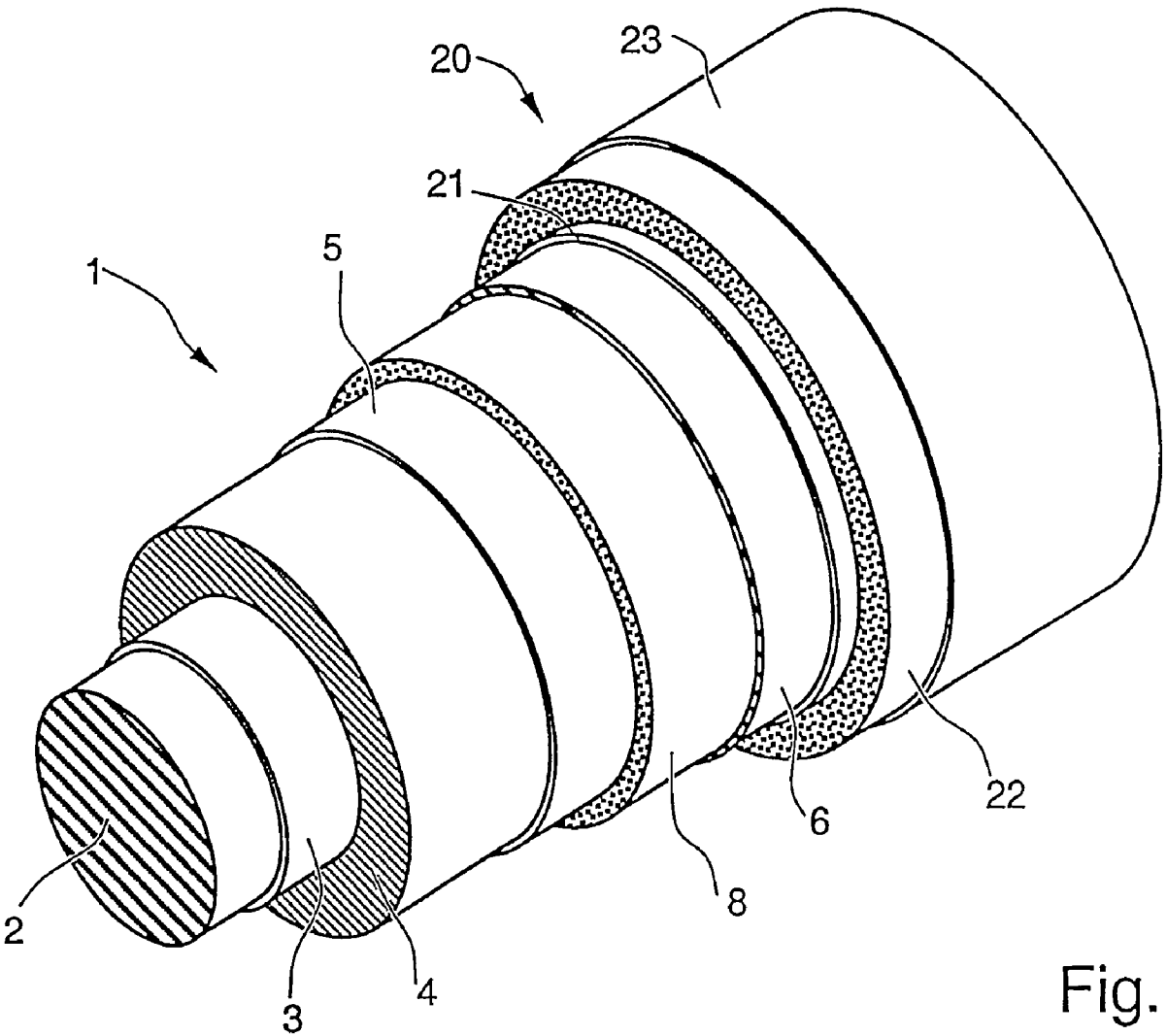
FIG. 1 is a perspective view of an electrical cable, according to the present invention.

FIG. 1 shows a perspective view, partially in cross section, of an electrical cable 1 according to the invention, typically designed for use in medium or high voltage range.

A power transmission cable of the type here described typically operates at nominal frequencies of 50 Hz or 60 Hz.

The cable 1 comprises: a conductor 2; an inner semiconductive layer 3; an insulating layer 4; an outer semiconductive layer 5; a metal shield 6 and a protective element 20.

Preferably, the conductor 2 is a metal rod, preferably made of copper or aluminum. Alternatively, the conductor 2 comprises at least two metal wires, preferably of copper or aluminum, which are stranded together according to conventional techniques.

The cross sectional area of the conductor 2 is determined in relationship with the power to be transported at the selected voltage. Preferred cross sectional areas for cables according to the present invention range from 16 $mm^2$ to 1000 $mm^2$.

In the present description, the term "insulating material" is used to refer to a material having a dielectric rigidity of at least 5 kV/mm, preferably greater than 10 kV/mm. For medium-high voltage power transmission cables, the insulating material has a dielectric rigidity greater than 40 kV/mm.

Typically, the insulating layer of power transmission cables has a dielectric constant (K) of greater than 2.

The insulating layer 4 is made from a non-crosslinked insulating material according to the present invention.

The inner semiconductive layer 3 which is in a position radially internal to the insulating layer 4, and the outer semiconductive layer 5 which is in a position radially external to the insulating layer 4, both non-expanded, are obtained according to known techniques, in particular by extrusion, the base polymeric material and the carbon black (the latter being used to cause said layers to become semiconductive) being selected from those mentioned in the following of the present description.

In a preferred embodiment of the present invention, the inner and outer semiconductive layers 3, 5, comprise a non-crosslinked base polymeric material, more preferably a polypropylene compound.

In a more preferred embodiment of the present invention, the inner and outer semiconductive layers 3, 5, are made from a non-crosslinked material comprising a thermoplastic polymer and a predetermined amount of a dielectric liquid, said thermoplastic polymer and said dielectric liquid being selected from those above disclosed.

In a still more preferred embodiment, the inner and outer semiconductive layers 3, 5, are made from a non-crosslinked material comprising the same thermoplastic polymer and the same dielectric liquid of the non-crosslinked insulating material of the insulating layer 4.

In the preferred embodiment shown in FIG. 1, the metal shield 6 is made of a continuous metal sheet, preferably of aluminum or, alternatively, copper, shaped into a tube. In some cases, also lead can be used.

The metal sheet forming the metal shield 6 is folded lenghtwise around the outer semiconductive layer 5 with overlapping edges. Conveniently, a sealing and bonding material is interposed between the overlapping edges, so as to make the metal shield watertight. Alternatively, the metal sheet edges can be welded.

Alternatively, the metal shield 6 is made of helically wound metal wires or strips placed around said outer semiconductive layer 5.

Preferably, the metal shield is coated with an oversheath (not shown in FIG. 1) made from a non-crosslinked polymer, for example polyvinyl chloride (PVC) or polyethylene (PE).

According to the preferred embodiment shown in FIG. 1, in a position radially external to said metal shield 6, the cable 1 is provided with a protective element 20. According to said embodiment, the protective element 20 comprises an expanded polymeric layer 22 which is included between two non-expanded polymeric layers, an outer (first) non-expanded polymeric layer 23 and an inner (second) non-expanded polymeric layer 21 respectively. The protective element 20 has the function of protecting the cable from any external impact, occurring onto the cable, by at least partially absorbing said impact.

According to European Patent EP 981,821, the expanded polymeric layer 22 may comprise any type of expandable polymer which can be selected, for example, from: polyolefins, copolymers of different olefins, copolymers of an olefin with an ethylenically unsaturated ester, polyesters, polycarbonates, polysulphones, phenol resins, urea resins, or mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); elastomeric ethylene/propylene copolymers (EPR) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof or mixtures thereof.

Preferably, said expandable polymer can be selected from polyolefin polymers or copolymers based on ethylene and/or propylene. More preferably, said expandable polymer can be selected from:

(d) copolymers of ethylene with an ethylenically unsaturated ester, for example vinyl acetate or butyl acetate, in which the amount of unsaturated ester is generally between 5% by weight and 80% by weight, preferably between 10% by weight and 50% by weight;

(e) elastomeric copolymers of ethylene with at least one $C_3$-$C_{12}$ α-olefin, and optionally a diene, preferably ethylene/propylene (EPR) or ethylene/propylene/diene (EPDM) copolymers, generally having the following composition: 35%-90% mole of ethylene, 10%-65% mole of α-olefin, 0%-10% mole of diene (for example 1,4-hexadiene or 5-ethylidene-2-norbornene);

(f) copolymers of ethylene with at least one $C_4$-$C_{12}$ α-olefin, preferably 1-hexene, 1-octene and the like, and optionally a diene, generally having a density of between 0.86 $g/cm^3$ and 0.90 $g/cm^3$ and the following composition: 75%-97% by mole of ethylene; 3%-25% by mole of α-olefin; 0%-5% by mole of a diene;

(g) polypropylene modified with ethylene/$C_3$-$C_{12}$ α-olefin copolymers, wherein the weight ratio between polypropylene and ethylene/$C_3$-$C_{12}$ α-olefin copolymer is comprised between 90/10 and 10/90, preferably between 80/20 and 20/80.

For example, the commercial products Elvax® (DuPont), Levapren® (Bayer) and Lotryl® (Elf-Atochem) are in class (d), products Dutral® (Enichem) or Nordel® (Dow-DuPont) are in class (e), products belonging to class (f) are Engage® (Dow-DuPont) or Exact® (Exxon), while polypropylene modified with ethylene/alpha-olefin copolymers (g) are commercially available under the brand names Moplen® or Hifax® (Basell), or also Fina-Pro® (Fina), and the like.

Within class (g), particularly preferred are thermoplastic elastomers comprising a continuous matrix of a thermoplastic polymer, e.g. polypropylene, and fine particles (generally having a diameter of the order of 1 μm-10 μm) of a cured elastomeric polymer, e.g. crosslinked EPR o EPDM, dispersed in the thermoplastic matrix. The elastomeric polymer can be incorporated in the thermoplastic matrix in the uncured state and then dinamically crosslinked during processing by addition of a suitable amount of a crosslinking agent. Alternatively, the elastomeric polymer can be cured separately and then dispersed into the thermoplastic matrix in the form of fine particles. Thermoplastic elastomers of this type are described, e.g. in U.S. Pat. No. 4,104,210 or in European Patent Application EP 324,430. These thermoplastic elastomers are preferred since they proved to be particularly effective in elastically absorb radial forces during the cable thermal cycles in the whole range of working temperatures.

For the purposes of the present description, the term "expanded" polymer is understood to refer to a polymer within the structure of which the percentage of "void" volume (that is to say the space not occupied by the polymer but by a gas or air) is typically greater than 10% of the total volume of said polymer.

In general, the percentage of free space in an expanded polymer is expressed in terms of the degree of expansion (G). In the present description, the term "degree of expansion of the polymer" is understood to refer to the expansion of the polymer determined in the following way:

$$G(\text{degree of expansion})=(d_0/d_e-1)\times 100$$

where $d_0$ indicates the density of the non-expanded polymer (that is to say the polymer with a structure which is essentially free of void volume) and $d_e$ indicates the apparent density measured for the expanded polymer.

Preferably, the degree of expansion of said expanded polymeric layer 22 is selected in the range of from 20% to 200%, more preferably from 25% to 130%.

Preferably, the two non-expanded polymeric layers 21, 23 of said protective element 20 are made of polyolefin materials.

Preferably, the first polymeric non-expanded layer 23 is made of a thermoplastic material, preferably a polyolefin, such as non-crosslinked polyethylene (PE); alternatively, polyvinyl chloride (PVC) can be used.

In the embodiment shown in FIG. 1, cable 1 is further provided with a water-blocking layer 8 placed between the outer semiconductive layer 5 and the metal shield 6.

According to one preferred embodiment of the invention, the water-blocking layer 8 is an expanded, water swellable, semiconductive layer as described in International Patent Application WO 01/46965.

Preferably, said water-blocking layer 8 is made of an expanded polymeric material in which a water swellable material is embedded or dispersed.

Preferably, the expandable polymer of said water-blocking layer 8 is selected from the polymers mentioned above.

Said water-blocking layer 8 aims at providing an effective barrier to the longitudinal water penetration to the interior of the cable.

As shown by tests carried out by the Applicant, said expanded polymeric layer is able to incorporate large amounts of water swellable material and the incorporated water-swellable material is capable of expanding when the expanded polymeric layer is placed in contact with moisture or water, thus efficiently performing its water-blocking function.

The water swellable material is generally in a subdivided form, particularly in the form of powder. The particles constituting the water-swellable powder have preferably a diameter not greater than 250 μm and an average diameter of from 10 μm to 100 μm. More preferably, the amount of particles having a diameter of from 10 μm to 50 μm are at least 50% by weight with respect to the total weight of the powder.

The water-swellable material generally consists of a homopolymer or copolymer having hydrophilic groups along the polymeric chain, for example: crosslinked and at least partially salified polyacrylic acid (for example, the products Cabloc® from C. F. Stockhausen GmbH or Waterlock® from Grain Processing Co.); starch or derivatives thereof mixed with copolymers between acrylamide and sodium acrylate. (for example, products SGP Absorbent Polymer® from Henkel A G); sodium carboxymethylcellulose (for example, the products Blanose® from Hercules Inc.).

To obtain an effective water-blocking action, the amount of water-swellable material to be included in the expanded polymeric layer is generally of from 5 phr to 120 phr, preferably of from 15 phr to 80 phr (phr=parts by weight with respect to 100 parts by weight of base polymer).

In addition, the expanded polymeric material of the water-blocking layer 8 can be modified to be semiconductive.

Products known in the art for the preparation of semiconductive polymer compositions can be used to give semiconductive properties to said polymeric material. In particular, an electroconductive carbon black can be used, for example electroconductive furnace black or acetylene black, or mixtures thereof. The surface area of the carbon black is generally greater than 20 $m^2/g$, usually between 40 $m^2/g$ and 500 $m^2/g$. Advantageously, a highly conducting carbon black can be used, having a surface area of at least 900 $m^2/g$, such as, for example, the furnace carbon black known commercially under the trade name Ketjenblack® EC (Akzo Chemie N V).

The amount of carbon black to be added to the polymeric matrix may vary depending on the type of polymer and of carbon black used, the degree of expansion which it is intended to obtain, the expanding agent, etc. The amount of carbon black thus has to be such as to give the expanded material sufficient semiconductive properties, in particular such as to obtain a volumetric resistivity value for the expanded material, at room temperature, of less than 500 Ω·m, preferably less than 20 Ω·m. Typically, the amount of carbon black may range between 1% by weight and 50% by weight, preferably between 3% by weight and 30% by weight, relative to the weight of the polymer.

A preferred range of the degree of expansion of the water-blocking layer 8 is from 10% to 60%.

Furthermore, by providing cable 1 with a serniconductive water-blocking layer 8, the thickness of the outer semiconductive layer 5 can be advantageously reduced since the electrical property of the outer semiconductive layer 5 is partially performed by said water-blocking semiconductive layer. Therefore, said aspect advantageously contributes to the reduction of the outer semiconductive layer thickness and thus of the overall cable weight.

Electrical Design of the Insulating Layer

Generally, the insulating layer of a cable is dimensioned to withstand the electrical stress conditions prescribed for the category of use of said cable.

In particular, when the cable is in operation, the conductor 2 is maintained at the nominal operating voltage of the cable and the shield 6 is connected to earth (i.e. it is at 0 voltage).

Nominally, the inner semiconductive layer 3 is at the same voltage as the conductor and the outer semiconductive layer 5 and the water-blocking layer 8 are at the same voltage as the metal shield 6.

Depending on the insulating layer thickness, this determines an electrical voltage stress across the insulating layer which must be compatible with the dielectric rigidity of the material of the insulating layer (including a suitable safety factor).

The electric voltage stress Γ around a cylindrical conductor is defined by the following formula:

$$\Gamma = U_0 \Big/ \left(r \cdot \ln \frac{r_i}{r_c}\right) \quad (1)$$

wherein:

$U_0$ is the phase to ground voltage;

$r_i$ is the radius at the insulating layer surface;

$r_c$ is the radius at the conductor surface (or at the surface of the inner semiconductive layer, if present).

The equation (1) refers to the AC voltage regime. A different and more complex expression is available for the DC voltage regime.

For example, the International Standard CEI IEC 60502-2 (Edition 1.1-1998-11-pages 18-19), in case of an insulating layer made of crosslinked polyethylene (XLPE), provides for an insulating layer nominal thickness values of 5.5 mm in correspondence with a voltage V of 20 KV and with a conductor cross-section ranging from 35 $mm^2$ to 1000 $mm^2$. As a further example, in case a voltage V of 10 KV and a conductor cross-section ranging from 16 $mm^2$ to 1000 $mm^2$ are selected, according to said Standard the cable insulating layer has to be provided with a nominal thickness value of 3.4 mm.

Impact Protection

According to the present invention, the protective element 20 prevents the insulating layer 4 from being damaged by possible impacts due, for example, to stones, tools or the like impacting on the cable during transport or laying operations.

For example, a common practice is to lay a cable in a trench dug in the soil at a predetermined depth, and subsequently to fill the trench with the previously removed material.

In case the removed material includes stones, bricks or the like, it is not uncommon that a piece of a weight of some kilos falls from significant height (many tens of centimeters, up to one meter or more) on the cable, so that the impact involves a relatively high energy.

Other possible sources of impacts during the laying operations are the operating machines, which may hit the cable in case of possible errors, excess of speed, etc., in their movements.

Figure 2:
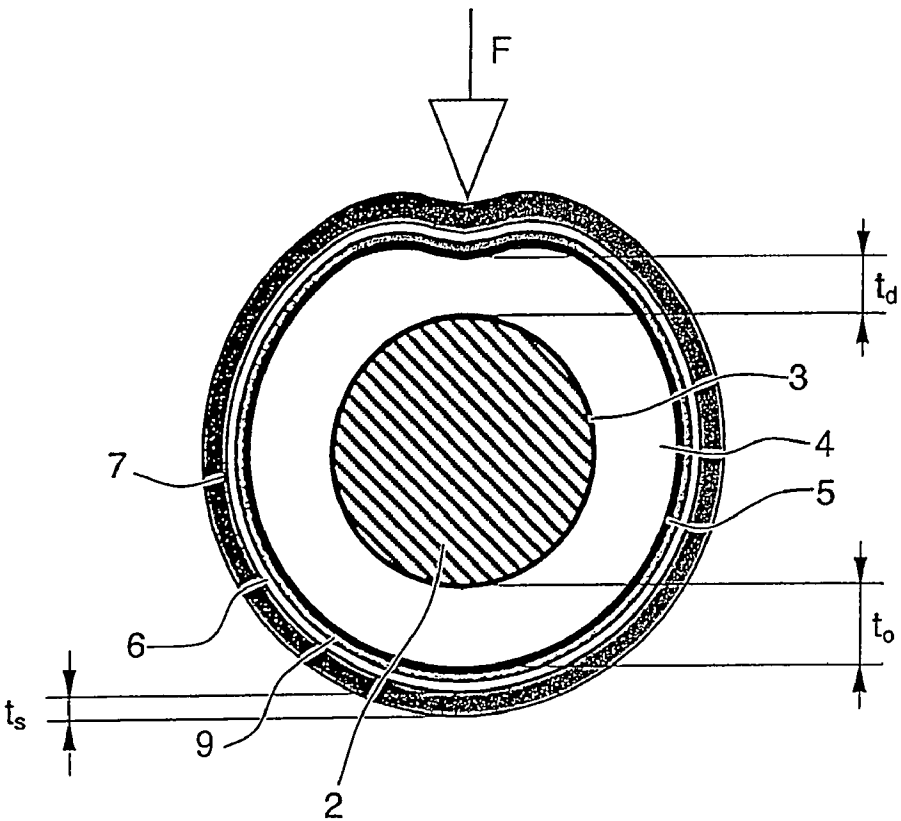
FIG. 2 is a cross-sectional view of a comparative electrical cable, damaged by an impact.

The effects of an impact F on a comparative cable are schematically shown in FIG. 2, where the same reference numerals have been used to identify corresponding elements already described with reference to FIG. 1.

The cable of FIG. 2 is provided with an oversheath 7 positioned outside the metal shield 6. Typically the oversheath 7 is made of a polymeric material, such as polyethylene or PVC.

The cable of FIG. 2 is further provided with a water swellable tape 9 to avoid any longitudinal water penetration to the interior of the cable.

As shown in FIG. 2, as a consequence of the impact F, the cable is locally deformed.

Generally, the materials used for the insulating layer and the oversheath of the cable elastically recover only part of their original size and shape after the impact, so that after the impact, even if it has taken place before the cable is energized, the insulating layer thickness withstanding the electric stress is reduced.

However, the Applicant has observed that, when a metal shield is used outside the cable insulating layer, the material of such shield is permanently deformed by the impact, further limiting the elastic recover of the deformation, so that the insulating layer is restrained from elastically recovering its original shape and size.

Consequently, the deformation, or at least a significant part thereof, caused by the impact is maintained after the impact, even if the cause of the impact itself has been removed. Said deformation results in that the insulating layer thickness changes from the original value $t_0$ to a "damaged" value $t_d$ (see FIG. 2).

Accordingly, when the cable is being energized, the real insulating layer thickness which is bearing the electric voltage stress (Γ) in the impact area is no more $t_0$, but rather $t_d$.

In case the value $t_0$ is selected with sufficient excess, for example as provided for by the Standard cited before, with respect to the operating voltage of the cable, this may still be enough to allow the cable to operate safely also in the impacted zone.

However, the need to allow the safe operation also in a damaged area causes the whole cable to be made with an insulating layer thickness significantly larger than needed.

In addition, if the area of the impact is subsequently involved in some additional operations, for example if a joint is made in such area, conditions may arise where the electric stress is increased more than acceptable (either for the cable or for the associated accessory, which can be working on a diameter different from the one it has been designed for), even if a certain safety excess has been provided in the insulating layer thickness.

Impact Resistance Evaluation

The impact energy has been evaluated in view of the various parameters which have been found relevant to the impact and of the relevant probability for different classes of cables.

For example, in case the impact is caused by an object falling on the cable, the impact energy depends both on the mass of the object impacting upon the cable and on the height from which said object falls down.

Accordingly, when the cable is laid in a trench or the like, the impact energy depends, among other factors, on the depth at which the cable is laid, said impact energy increasing with the depth.

Accordingly, it has been found that the impact energy is different for different classes of cables in accordance with their respective depths of lay.

Furthermore, for cables laid in a trench or the like, the presence of excavation debris, which are generally involved during the laying operations, affects the probability of an accidental impact on the cable and their size contributes to determine the energy of a possible impact. Other factors, such as the unitary weight of the cable and the size of the operating machines used in the laying operations have also been considered.

In view of the analysis above, for each class of cables (e.g. LV, MV, HV), reference impacts energies have been identified as having a significant probability of occurrence; in correspondence of these impacts, a particular cable structure has been defined as capable to support such impacts.

In particular, for a MV cable an impact of energy of 50 J has been identified as representative of a significant event in the cable use and laying.

Such impact energy can be achieved, for example, by allowing a conically shaped body of 27 kg weight to fall from a height of 19 cm on the cable. In particular, the test body has an angle of the cone of 90°, and the edge is rounded with a radius of about 1 mm.

In the present description, the term "impact" is intended to encompass all those dynamic loads of a certain energy capable to produce substantial damages to the structure of the cables.

For cables for low voltage and high voltage applications (LV, HV) impact energies of 25 J and 70 J respectively have been identified.

To the purposes of the present invention, it has been considered that the cable is satisfactorily protected if a permanent deformation smaller than 0.1 mm (which is the precision limit of the measurement) after 4 subsequent impacts in the same position has occurred.

Figure 3:
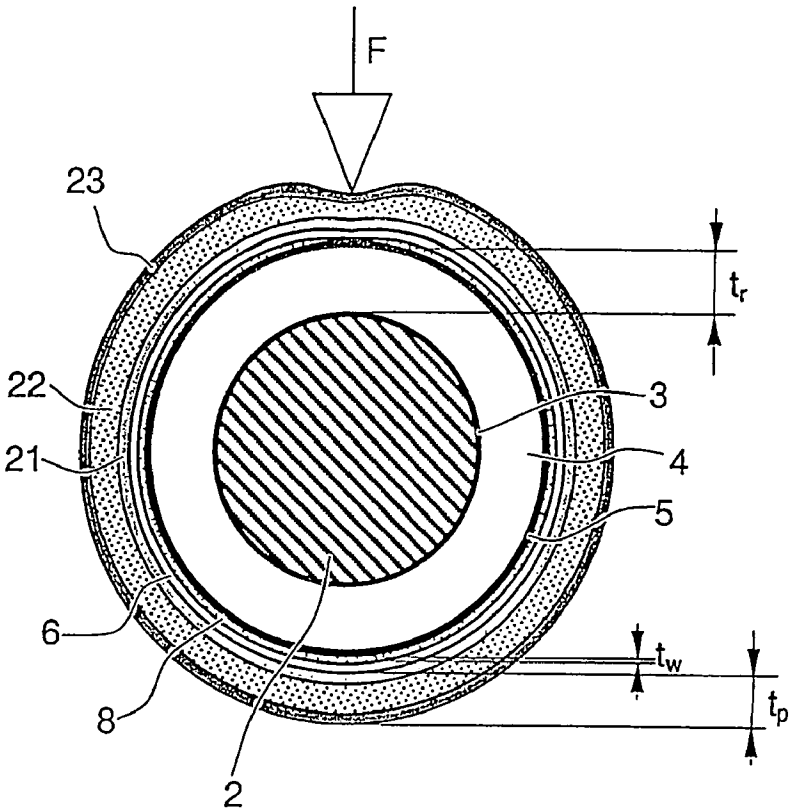
FIG. 3 is a cross-sectional view of an electrical cable, according to the present invention, in the presence of protective element deformation caused by an impact.

When an impact is caused against a cable according to the present invention, as shown in FIG. 3, the protective element 20, either alone, or, preferably, in combination with the expanded water-blocking layer 8, is capable of reducing the deformation of the insulating layer 4.

According to the present invention it has been found that a protective element 20 having a thickness $t_p$, combined with an insulating layer thickness selected at a "reduced" value $t_r$, may result in a cable which may satisfactorily pass the impact resistance test indicated before, still maintaining the capability of safely operating in the selected voltage class.

The insulating layer thickness can be determined by selecting the most restrictive electric limitation to be considered for its intended use, without the need of adding extra thickness to take into account deformations due to impacts.

For example, it is typical to consider in a cable design as significant electric limitations the maximum gradient on the conductor surface (or on the outer surface of the inner semiconductive layer extruded thereon), and the gradient at the joints, i.e. the gradient on the outer surface of the cable insulating layer.

The gradient on the conductor surface is compared with the maximum acceptable gradient of the material used for the insulating layer (e.g. about 18 kV/mm in the case of polyolefin compounds) and the gradient at the joints is compared with the maximum acceptable gradient of the joint device which is envisaged for use with the cable.

For example, a cable joint can be made by replacing the insulating layer on the conductor joining area with an elastic (or thermo-shrinking) sleeve, which overlaps for a certain length the exposed cable insulating layer.

In case such type of joints may safely operate with a gradient of about 2.5 kV/mm (for a MV cable), this is likely to be the most restrictive condition and the insulating layer thickness is determined to withstand such condition. In case another condition may turn out to be more restrictive, such condition shall be take into account for the insulating layer thickness design.

According to the present invention, however, no extra thickness has to be provided to take into account insulating layer deformation caused by impacts.

It has also been found that, when the protective element 20 is used in combination with an insulating layer thickness selected at a "reduced" value $t_r$, the overall cable weight is lower than the corresponding weight of a cable without impact protection (i.e. without an impact protective element comprising an expanded polymeric layer) and with a traditional insulating layer thickness to (i.e. the cable of FIG. 2), capable of resisting to the same impact energy (even if by admitting a deformation of the insulating layer).

The presence of an expanded water-blocking layer 8 has also been found to further contribute to the impact resistance, allowing to further reduce the deformation of the insulating layer 4.

Insulating layer thickness and overall cable weights for two cables according to the present invention as well as for a comparative cable (whose design gets through the impact resistance test described above) are shown in Table 1, for 20 kV class voltage cables and an aluminum conductor cross-section of 50 mm$^2$.

TABLE 1

| | Thickness (mm) | | | | | | | | | |
|---|---|---|---|---|---|---|---|---|---|---|
| | | Protective element | | | Water | | | | | |
| Cable Type | Oversheath | Second (inner) non-expanded layer | Expanded layer | First (outer) non-expanded layer | blocking expanded layer | Water swellable tapes | Aluminum metallic screen | Insulating layer | Cable weight (kg/m) | Overall diameter (mm) |
| 1 | — | 1 | 1.5 | 4.4 | — | 0.15 | 0.3 | 4 | 0.74 | 30.7 |
| 2 | — | 1 | 1.5 | 0.85 | 0.5 | — | 0.3 | 4 | 0.51 | 24.9 |
| 3 | 8.25 | — | — | — | — | 0.2 | 0.3 | 4 | 0.90 | 33.9 |

In details:

(a) Cable 1 is a cable of the present invention comprising a non-expanded water-blocking layer 8 made of water swellable tapes, said cable further comprising a protective element 20 including: a first non-expanded polymeric layer 23; an expanded polymeric layer 20; a second non-expanded polymeric layer 21;

(b) Cable 2 is a cable of the present invention comprising an expanded water-blocking layer 8, said cable further comprising a protective element 20 including: a first non-expanded polymeric layer 23; an expanded polymeric layer 22; a second non-expanded polymeric layer 21;

(c) Cable 3 is a comparative cable of the type shown in FIG. 2 comprising: an oversheath and a water swellable blocking layer made of water swellable tapes.

Furthermore, Table 1 shows that in the case an expanded water-blocking layer 8 is provided, the thickness of the protective element 20 is advantageously reduced (and the overall cable weight is decreased) maintaining the same insulating layer thickness.

Moreover, Table 1 shows that the comparative cable would have required a remarkable weight (i.e. of about 0.90 kg/m) to maintain its operability in the same impact conditions in comparison with the cables of the present invention.

Table 2 contains examples of insulating layer dimensions for cables according to the present invention for different operating voltage classes in the MV range, compared with the corresponding insulating layer thickness prescribed by the above cited International Standard CEI IEC 60502-2, for cross-linked polyethylene (XLPE) insulating layer.

TABLE 2

| | 10 kV | 20 kV | 30 kV |
|---|---|---|---|
| Insulating layer thickness (mm) of a cable of the invention | 2.5 | 4 | 5.5 |
| Insulating layer thickness (mm) according to Standard CEI IEC 60502-2 | 3.4 | 5.5 | 8 |

According to the values reported in Table 2, the insulating layer thickness provided to a cable of the present invention is 26%, 27% and 56% smaller than the corresponding insulating layer thickness according to said Standard respectively.

Impact Protective Element Dimension

The protective element dimension has been evaluated for different cable sections in order to provide the absence of deformation to the insulating layer for the different conductor sections.

To this purpose, the thickness of a protective element corresponding to insulating layer deformation ≦0.1 mm upon impact of 50 J energy has been determined in correspondence of various conductor cross-sectional areas, both in case of presence of an expanded water-blocking layer and in case of presence of a non-expanded water-blocking layer.

The protective element thickness has been varied by maintaining constant the thickness of the second non-expanded layer 21 and of the expanded polymeric layer 22, while increasing the thickness of the first non-expanded layer 23.

Figure 4:
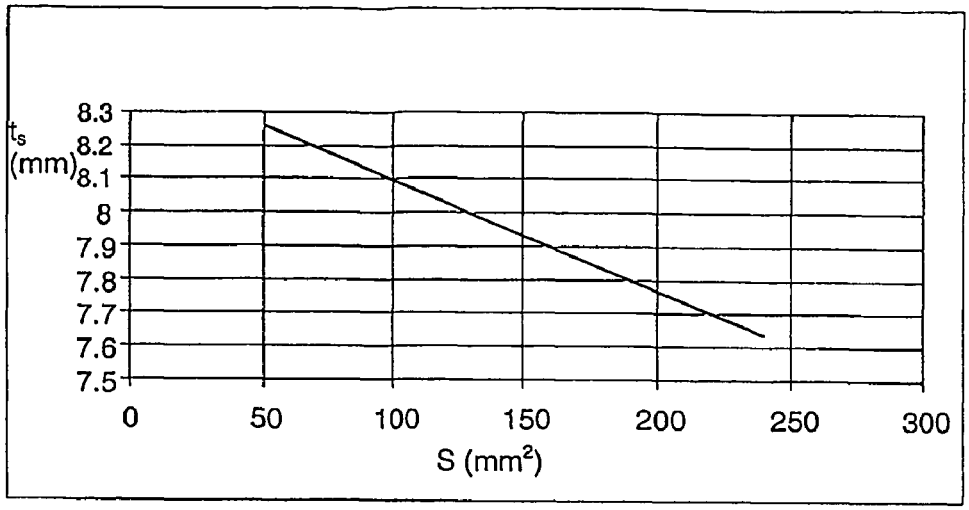
FIG. 4 is a graph showing the relationship between the thickness of the oversheath and the conductor cross-sectional area as designed to prevent insulating layer damage upon impact in a traditional cable.

The corresponding thickness of a non-expanded oversheath 7 has also been selected for cables not provided with said protective element 20 (see FIG. 4).

Figure 5:
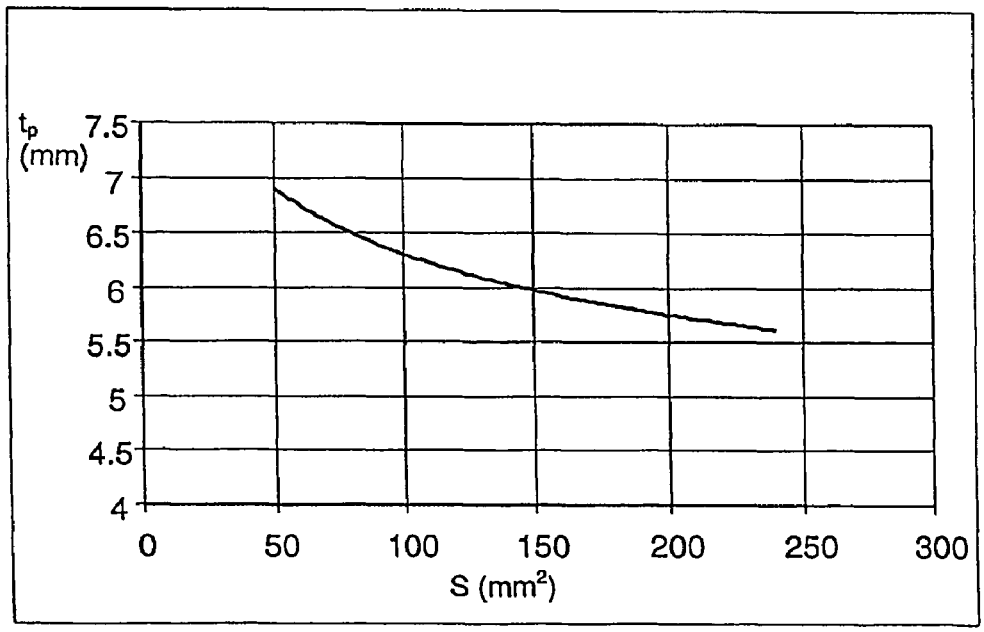
FIG. 5 is a graph showing the relationship between the thickness of the cable protective element and the conductor cross-sectional area as designed to prevent insulating layer damage upon impact in the cable in accordance with the present invention.

It has been found that the thickness of said protective element decreases in correspondence with the increase of the conductor cross-sectional area (see FIG. 5).

Figure 6:
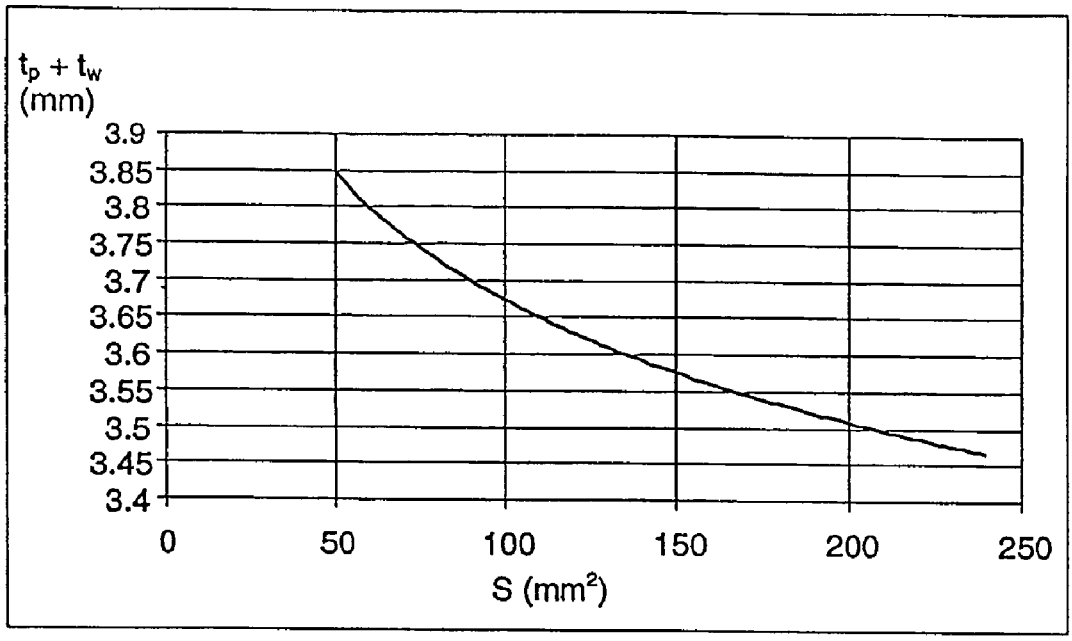
FIG. 6 is a graph showing the relationship between the thickness of the protective element and the conductor cross-sectional area as designed to prevent insulating layer damage upon impact in a cable provided with two expanded polymeric layers according to the present invention.

It has also been found that the presence of an expanded water-blocking layer 8 allows to use a significantly thinner protective element 20 (see FIG. 6 in comparison with FIG. 5).

The results are shown in FIGS. 4, 5, 6, respectively for a comparative cable with an oversheath 7, a cable with the protective element 20, and a cable with both the protective element 20 and the expanded water-blocking layer 8.

In said figures, the oversheath thickness $t_s$ with reference to FIG. 4, the protective element thickness $t_p$ with reference to FIG. 5, and the sum of the protective element thickness $t_p$ and of the water-blocking layer thickness $t_w$ with reference to FIG. 6, are plotted in function of conductor cross-sectional area S for the 20 kV voltage class.

The Applicant has also found that the increase of the mechanical protection against impacts is obtained by increasing the first non-expanded layer thickness, while maintaining constant the expanded polymeric layer thickness.

The cable according to the present invention can be prepared using known techniques for depositing layers of thermoplastic material, for example by means of extrusion. The extrusion can be advantageously carried out in a single pass, for example by means of different "extrusion blocks" along the extrusion line wherein individual extruders arranged in series are used, or by means of co-extrusion with a multiple-extrusion head.

The following present invention is further described in the following examples, which are merely for illustration and must not be regarded in any way as limiting the same.

EXAMPLES 1-2

Compositions Preparation

The following components were used:

- a propylene heterophase copolymer with melting point 165° C., melting enthalpy 30 J/g, MFI 0.8 dg/min and flexural modulus 150 MPa (Adflex® Q 200 F—commercial product of Basell);
- Sunpar® 2280 (commercial product of Sunoco): paraffinic oil;
- Jarylec® Exp3 (commercial product of Elf Atochem): dibenzyltoluene (DBT).

The following compositions were made:

Example 1: 94% by weight Adflex® Q 200 F+6% by weight Sunpar® 2280;

Example 2: 94% by weight Adflex® Q 200 F+6% by weight Jarylec® Exp3.

The above compositions were made as follows.

The polymer (Adflex® Q 200 F) in granular form was preheated, under agitation, at 80° C., over 15 min, in a turbomixer. Subsequently, the dielectric liquid (Sunpar® 2280 for Example 1 and Jarylec® Exp3 for Example 2), 6% by weight, was added to the preheated polymer. After the addition, agitation was continued for 2 hours at 80° C. until the liquid was completely absorbed in the polymer granules.

After this first stage, the resultant material was kneaded in a laboratory twin-screw Brabender Plasticorder PL2000 at a temperature of 180° C. to complete homogenization. The resultant material left the twin-screw extruder in the form of granules.

Measurement of Dielectric Losses

Plates of 0.5 mm thickness were formed from the granular material obtained as disclosed above. The plates were molded at 195° C. with 15 min preheating.

The plates obtained in this manner were subjected to dielectric loss measurement by measuring the tangent of the loss angle (tandelta) (according to ASTM standard D150) at different temperatures. The tandelta$\times 10^{-4}$ (G=1 kV/mm at 50 Hz) at 20° C. and tandelta$\times 10^{-4}$ (G=1 kV/mm at 50 Hz) at 90° C. were measured: the obtained results are given in Table 3.

TABLE 3

| EXAMPLE | G (kV/mm) | tandelta (20° C.) | tandelta (90° C.) |
|---|---|---|---|
| 1 | 1 | $3.7 \times 10^{-4}$ | $5.7 \times 10^{-4}$ |
| 2 | 1 | $2.0 \times 10^{-4}$ | $4.0 \times 10^{-4}$ |

The above reported data show that the use of a dielectric liquid did not negatively affect the dielectric losses of the insulating material.

EXAMPLE 3

Cable Production

A cable according to the present invention and a comparative cable were produced, the compositions of the insulating layer and of the semiconductive layers of said cables being described in Table 4 below.

TABLE 4

| | Cable according to the present invention | | Comparison cable | |
|---|---|---|---|---|
| | Inner and outer semicond. layers (%) by weight | Insulating layer (%) by weight | Inner and outer semicond. layers (%) by weight | Insulating layer (%) by weight |
| Adflex ® Q 200 F | 60.4 | 93.4 | 66.4 | 99.4 |
| Ensaco ® 250 G | 33 | — | 33 | — |
| Sunpar ® 2280 | 6 | 6 | — | — |
| Irganox ® PS 802 | 0.4 | 0.4 | 0.4 | 0.4 |
| Irganox ® 1010 | 0.2 | 0.2 | 0.2 | 0.2 |

Ensaco ® 250 G: furnace carbon black (commercial product of Erachem Europe);
Irganox ® PS 802 (antioxidant): distearyl thiodipropionate (commercial product of Ciba Specialty Chemicals);
Irganox ® 1010 (antioxidant): pentaerithrityl-tetrakis-(3-(3,5-di-t-butyl-4-hydroxy-phenyl)-propionate (commercial product of Ciba Specialty Chemicals).

The cable core (on which the expanded layer was to be deposited) consisted of: an aluminum conductor (cross-section 150 $mm^2$), an inner semiconductive layer of about 0.5 mm in thickness, an insulating layer of about 4.5 mm in thickness, an outer semiconductive layer of about 0.5 mm in thickness, said layers being obtained as disclosed below.

The cable was prepared by co-extrusion of the three layers above reported by means of three extruders opening into a single extrusion head.

The materials used for the inner semiconductive layer (in the quantities reported in the above Table 4), namely the Adflex® Q 200 F, the Sunpar® 2280, the carbon black and the antioxidants, previously mixed in an internal mixer of the Banbury type, were fed to the extruder hopper of an extruder having a diameter of 45 mm and a L/D ratio of 25.

The materials used for the insulating layer (in the quantities reported in the above Table 4) were compounded by means of an extruder having a diameter of 80 mm and a L/D ratio of 25. Thus, the Adflex® Q 200 F was fed directly into the extruder hopper. Subsequently, the Sunpar® 2280, previously mixed with the antioxidants in a glass vessel, was injected at high pressure into the extruder. The injection was made during the extrusion at about 20 D from the beginning of the extruder screw by means of three injections points on the same cross-section, each injection point being at 120° from each other. The dielectric liquid was injected at a temperature of 70° C. and a pressure of 250 bar.

The materials used for the outer semiconductive layer (in the quantities reported in the above Table 4) namely, the Adflex® Q 200 F, the Sunpar® 2280, the carbon black and the antioxidants, previously mixed in an internal mixer of the Banbury type, were fed to the extruder hopper of an extruder having a diameter of 45 mm and a L/D ratio of 25.

The compounded materials were co-extruded on said aluminum conductor.

The cable core leaving the extrusion head was cooled to ambient temperature by passing it through cold water.

A water blocking semiconductive expanded layer, having a thickness of about 0.7 mm and a degree of expansion of 28%, was extruded on the above disclosed cable core by means of an extruder having a diameter of 60 mm and a L/D ratio of 20. The materials used for said expanded layer were the following:

Santoprene® 201/121-68 W228: thermoplastic rubber (commercial product of Advanced Elastomer System) (quantity=50 phr);

Profax® PF 814:a homopolymer of isotactic propylene with structure of high degree of branching (commercial product of Montell) (quantity=50 phr);

Waterlock® J550:cross-linked polyacrylic acid partially salified) (more than 50 wt. % of particles with diameter between 10 and 45 μm) (Grain Processing Co.) (quantity=40 phr);

Hydrocerol® BIH 40:carboxylic acid+sodium bicarbonate expanding agent (commercial product of Boeheringer Ingelheim) (quantity=2 phr);

Ensaco® 250 G:furnace carbon black (commercial product of Erachem Europe) (quantity=50 phr).

Said materials, except for the expanding agent, were previously mixed in an internal mixer of the Banbury type and subsequently fed into the extruder hopper together with the expanding agent.

The cable leaving the extrusion head was cooled in air at 60° C. before entering the aluminum forming device.

The so obtained cable was then wrapped with a lacquered aluminum screen of about 0.3 mm in thickness using an adhesive to bond the overlapping edges.

Subsequently, a polyethylene sheath of about 1.5 mm in thickness was extruded above said aluminum screen using a further extruder having a diameter of 150 mm and a L/D ratio of 25.

The cable leaving the extrusion head of said further extruder was cooled in water at 80° C. in a cooling pipe (distance from the extrusion head of 500 mm).

A further expanded layer, having a thickness of about 2 mm and a degree of expansion of 100%, was deposited on the above disclosed cable by means of an extruder having a diameter of 120 mm and a L/D ratio of 25. The materials used for said expanded layer was the following:

Hifax SD 817: a propylene modified with ethylene/propylene copolymer (commercial product of Basell) (quantity=100 phr);

Hydrocerol® BIH 40: carboxylic acid+sodium bicarbonate expanding agent (commercial product of Boeheringer Ingelheim) (quantity=1.2 phr).

Said materials were fed into the extruder hopper.

At a distance of about 500 mm from the extrusion head a cooling pipe (containing cold water) was provided in order to stop the expansion and to cool at 80° C. the extruded material.

Subsequently, a polyethylene sheath of about 1.5 mm in thickness was extruded above said further expanded layer using a further extruder having a diameter of 160 mm and a L/D ratio of 25.

The cable leaving the extrusion head of said further extruder was cooled in water at 50° C. in a cooling pipe (distance from the extrusion head of 500 mm).

Under similar conditions, by using the materials indicated in Table 4, a comparison cable was produced without adding the dielectric liquid.

Dielectric Strength

Three pieces (each being 20 meters in length) of the two cables produced as described above were subjected to dielectric strength measurement using alternating current at ambient temperature. Starting from 100 kV the gradient applied to the cables was increased by 10 kV every 10 minutes until the cables broke down. The break down gradient considered is that on the conductor.

Table 5 summarizes the results of the electrical tests: the data represent the average value obtained from three different measurements.

TABLE 5

| | Cable according to the present invention (kV/mm) | Comparison cable (kV/mm) |
|---|---|---|
| AC break down | 59 | 29 |

The above disclosed data clearly show that the cable according to the present invention broke down at a gradient higher than that one of the comparison cable.

The invention claimed is:

1. A cable for use in a predetermined voltage class, said cable comprising:

at least one conductor;

at least one extruded insulating layer surrounding said conductor, said insulating layer being made from a non-crosslinked insulating material comprising at least one thermoplastic polymer and at least one dielectric liquid, said insulating layer having a thickness such as to provide a voltage gradient on the outer surface of the insulating layer not smaller than 1.0 kV/mm; and a protective element around said extruded insulating layer having a thickness and mechanical properties selected to provide a predetermined impact resistance capability, said protective element comprising at least one expanded polymeric layer, said thickness being sufficient to prevent a detectable insulating layer damage upon impact of at least 25 J energy;

wherein said extruded insulating layer has a thickness at least 20% smaller than the insulating layer thickness provided for in IEC Standard 60502-2 (Edition 1.1-1998-11) for said predetermined corresponding voltage class.

2. The cable according to claim 1, wherein said predetermined voltage class is 10 kV and said extruded insulating layer has a thickness not higher than 2.5 mm.

3. The cable according to claim 1, wherein said predetermined voltage class is 20 kV and said extruded insulating layer has a thickness not higher than 4 mm.

4. The cable according to claim 1, wherein said predetermined voltage class is 30KV and said extruded insulating layer has a thickness not higher than 5.5 mm.

5. The cable according to claim 1, wherein said thermoplastic polymer material is selected from: polyolefins, copolymers of different olefins, copolymers of an olefin with an ethylenically unsaturated ester, polyesters, polyacetates, cellulose polymers, polycarbonates, polysulphones, phenol resins, urea resins, polyketones, polyacrylates, polyamides, polyamines, or mixtures thereof.

6. The cable according to claim 5, wherein said thermoplastic polymer material is selected from: polyethylene, low density polyethylene, medium density polyethylene, high density polyethylene, linear low density polyethylene, ultra-low density polyethylene, polypropylene, ethylene/vinyl ester copolymers, ethylene/vinyl acetate, ethylene/acrylate copolymers, ethylene/methyl acrylate, ethylene/ethyl acrylate, ethylene/butyl acrylate, ethylene/α-olefin thermoplastic copolymers, polystyrene, acrylonitrile/butadiene/styrene resins, halogenated polymers, polyvinyl chloride, polyurethane, polyamides, aromatic polyesters, polyethylene terephthalate, polybutylene terephthalate, copolymers thereof or mixtures thereof.

7. The cable according to claim 1, wherein said thermoplastic polymer material is selected from:

(a) at least one propylene homopolymer or at least one copolymer of propylene with at least one olefin comonomer selected from ethylene and an α-olefin other than propylene, said homopolymer or copolymer having a melting point greater than or equal to 130° C. and a melting enthalpy of 20 J/g to 100 J/g; and (b) a mechanical mixture comprising at least one propylene homopolymer or copolymer (a) and (c) at least one elastomeric copolymer of ethylene with at least one aliphatic α-olefin, and optionally a polyene.

8. The cable according to claim 7, wherein said propylene homopolymer or copolymer (a) is selected from:

($a_1$) propylene homopolymers or copolymers of propylene with at least one olefin comonomer selected from ethylene and an α-olefin other than propylene, having a flexural modulus of 30 MPa to 900 MPa; and ($a_2$) heterophase copolymers comprising a thermoplastic phase based on propylene and an elastomeric phase based on ethylene copolymerized with an α-olefin wherein the elastomeric phase is present in a quantity of at least 45 wt % with respect to the total weight of the heterophase copolymers.

9. The cable according to claim 8, wherein said heterophase copolymers of ($a_2$) are heterophase copolymers wherein the elastomeric phase comprises an elastomeric copolymer of ethylene and propylene comprising 15 wt % to 50 wt % ethylene and 50 wt % to 85 wt % propylene with respect to the weight of the elastomeric phase.

10. The cable according to claim 7, wherein said elastomeric copolymer of ethylene (c) is selected from:

($c_1$) copolymers having the following monomer composition: 35 mol %-90 mol % of ethylene; 10 mol %-65 mol % of an aliphatic α-olefin; and 0 mol %-10 mol % of a polyene; and ($c_2$) copolymers having the following monomer composition: 75 mol %-97 mol % of ethylene; 3 mol %-25 mol % of an aliphatic α-olefin; and 0 mol %-5 mol % of a polyene.

11. The cable according to claim 1, wherein said dielectric liquid is selected from: mineral oils, naphthenic oils, aromatic oils, alkyl benzenes, paraffinic oils, polyaromalic oils, mineral oils optionally containing at least one heteroatom selected from oxygen, nitrogen or sulphur, liquid paraffins, vegetable oils, soybean oil, linseed oil, castor oil, oligomeric aromatic polyolefins, paraffinic waxes, polyethylene waxes, polypropylene waxes, synthetic oils, silicone oils, aliphatic esters, tetraesters of pentaerythritol, esters of sebacic acid, phthalic esters, olefin oligomers, optionally hydrogenated polybutenes or polyisobutenes or mixtures thereof.

12. The cable according to claim 11, wherein the dielectric liquid is selected from: aromatic oils, paraffinic oils, and naphthenic oils.

13. The cable according to claim 1, wherein the weight ratio of dielectric liquid to thermoplastic polymer material is 1:99 to 25:75.

14. The cable according to claim 1, wherein said conductor is a solid rod.

15. The cable according to claim 1, further comprising an electric shield surrounding said insulating layer, said electric shield comprising a metal sheet shaped in tubular form.

16. The cable according to claim 1, wherein said protective element is placed in a position radially external to said insulating layer.

17. The cable according to claim 1, wherein the degree of expansion of said expanded polymeric layer is 20% to 200%.

18. The cable according to claim 1, wherein said expanded polymeric layer has a thickness of 1 mm to 5 mm.

19. The cable according to claim 1, wherein the expandable polymeric material of said expanded polymeric layer is selected from polyolefin polymers or copolymers based on ethylene and/or propylene.

20. The cable according to claim 19, wherein said expandable polymeric material is selected from:

(d) copolymers of ethylene with an ethylenically unsaturated ester in which the quantity of unsaturated ester is 5% to 80% by weight;

(e) elastomeric copolymers of ethylene with at least one $C_3$-$C_{12}$ α-olefin, and optionally, a diene, having the following composition: 35%-90% as moles of ethylene, 10%-65% as moles of α-olefin, and 0%-10% as moles of diene;

(f) copolymers of ethylene with at least one $C_4$-$C_{12}$ α-olefin, and optionally a diene, having a density of 0.86 to 0.90 g/cm$^3$;

(g) polypropylene modified with ethylene/$C_3$-$C_{12}$ α-olefin copolymers where the ratio by weight between polypropylene and the ethylene/$C_3$-$C_{12}$ α-olefin copolymer is 90/10 to 30/70.

21. The cable according to claim 1, wherein said protective element further comprises at least one non-expanded polymeric layer coupled with said expanded polymeric layer.

22. The cable according to claim 21, wherein said at least one non-expanded polymeric layer has a thickness of 0.2 mm to 1 mm.

23. The cable according to claim 22, wherein said at least one non-expanded polymeric layer is a polyolefin polymer.

24. The cable according to claim 22, wherein said at least one non-expanded polymeric layer is in a position radially external to said expanded polymeric layer.

25. The cable according to claim 22, wherein said at least one non-expanded polymeric layer is in a position radially internal to said expanded polymeric layer.

26. The cable according to claim 22, wherein said at least one non-expanded polymeric layer comprises at least a first and a second layer, and wherein said first non-expanded polymeric layer is in a position radially external to said expanded polymeric layer and a said second non-expanded polymeric layer is in a position radially internal to said expanded polymeric layer.

27. The cable according to claim 1, comprising a further expanded polymeric layer in a position radially internal to said protective element.

28. The cable according to claim 27, wherein said further expanded polymeric layer is in a position radially external to said insulating layer.

29. The cable according to claim 27, wherein said further expanded polymeric layer is a water-blocking layer comprising a water swellable material.

30. The cable according to claim 27, wherein said further expanded polymeric layer is semiconductive.

31. The cable according to claim 1, comprising an inner semiconductive layer in a position radially internal to the insulating layer.

32. The cable according to claim 1, comprising an outer semiconductive layer in a position radially external to the insulating layer.

33. The cable according to claim 1, wherein said predetermined voltage class belongs to a medium or high voltage range.

34. A cable for use in a predetermined voltage class, comprising:

at least one conductor;

at least one extruded insulating layer surrounding said conductor, said insulating layer being made from a non-crosslinked insulating material comprising at least one thermoplastic polymer and at least one dielectric liquid; and a protective element around said insulating layer comprising at least one expanded polymeric layer, the protective element thickness having a value smaller than 7.5 mm for a conductor cross-sectional area greater than or equal to 50 mm$^2$ and a value greater than 8.5 mm for a conductor cross-sectional area smaller than 50 mm$^2$.

35. The cable according to claim 34, wherein said predetermined voltage class is higher than 60 kV and said insulating layer is not detectably damaged upon impact of an energy of at least 70 J.

36. The cable according to claim 34, wherein said predetermined voltage class is not higher than 60 kV and said insulating layer is not detectably damaged upon impact of an energy of at least 50 J.

37. The cable according to claim 34, wherein said predetermined voltage class is lower than 10 kV and said insulating layer is not detectably damaged upon impact of an energy of at least 25 J.

38. A method for designing a cable comprising at least one conductor, at least one extruded insulating layer surrounding said conductor, said insulating layer being made from a non-crosslinked insulating material comprising at least one thermoplastic polymer and at least one dielectric liquid, and a protective element surrounding said insulating layer, said protective element comprising at least one polymeric expanded layer, comprising the steps of:

selecting a conductor cross-sectional area;

determining the thickness for said insulating layer compatible with safe operation in a predetermined voltage class on said selected conductor cross-sectional area in correspondence of one of a number of predetermined electrical limit conditions;

selecting the maximum insulating layer thickness among those determined in said number of predetermined electrical limit conditions;

determining the thickness of said protective element so that said insulating layer is not detectably damaged upon an impact caused on the cable of an energy of at least 50 J; and using said selected insulating layer and said determined protective element thickness in the design of a cable for said predetermined voltage class and selected conductor cross-sectional area.

39. The method according to claim 38, wherein said step of determining the thickness of said protective element comprises the step of determining the thickness of said expanded polymeric layer.

40. The method according to claim 38, wherein said step of determining the thickness of said protective element comprises the step of determining the thickness of said expanded polymeric layer and determining the thickness of at least one non-expanded polymeric layer associated with said expanded polymeric layer, said protective element comprising said at least one non-expanded polymeric layer.

41. The method according to claim 38, wherein said step of determining the thickness of at least one non-expanded polymeric layer comprises the step of correlating in inverse relationship the thickness of said at least one non-expanded polymeric layer with the conductor cross-sectional area.

* * * * *